United States Patent [19]

Wadell

[11] Patent Number: 4,750,315

[45] Date of Patent: Jun. 14, 1988

[54] PACKING MACHINE AND METHOD

[75] Inventor: Lars G. A. Wadell, Aastorp, Sweden

[73] Assignee: Nestec S.A., Vevey, Switzerland

[21] Appl. No.: 932,692

[22] Filed: Nov. 19, 1986

[30] Foreign Application Priority Data

Feb. 1, 1986 [EP] European Pat. Off. ..... 861013217

[51] Int. Cl.[4] ..... B65B 5/10; B65B 19/34

[52] U.S. Cl. ..... 53/475; 53/202; 53/534; 53/236; 53/244; 53/251

[58] Field of Search ..... 53/534, 251, 475, 443, 53/448, 263, 202; 198/424, 431

[56] References Cited

U.S. PATENT DOCUMENTS

| | | | |
|---|---|---|---|
| 2,540,945 | 2/1951 | Hart | 198/431 X |
| 2,590,823 | 3/1952 | Rhodes | 53/244 X |
| 3,572,005 | 3/1971 | Allen et al. | 53/534 |
| 3,765,149 | 10/1973 | Warkentin | 53/534 |
| 3,800,495 | 4/1974 | Kemper | 53/534 X |
| 4,389,832 | 6/1983 | Calvert | 53/534 X |
| 4,431,104 | 2/1984 | Orlowski et al. | 198/431 X |
| 4,575,993 | 3/1986 | Meyn | 53/534 |

*Primary Examiner*—Horace M. Culver

*Attorney, Agent, or Firm*—Vogt & O'Donnell

[57] ABSTRACT

Food products are packaged with a conveyor for carrying the food products to be packaged and a conveyor adapted to travel discontinuously for carrying open-topped containers beneath the leading edge of the food-product carrying conveyor at which point the container-carrying conveyor is inclined downwards in the direction of travel at an acute angle of less than 60° to the horizontal so that the food product articles which fall off the leading edge of the food-carrying conveyor are consecutively received by for filling the container in a compact row with the food product articles. A container-supporting conveyor means may be utilized for advancing and urging the containers into position for filling at the successive stopping positions.

17 Claims, 1 Drawing Sheet

PACKING MACHINE AND METHOD

BACKGROUND OF THE INVENTION

The present invention relates to packing a plurality of food products into containers.

The packing of many food products, for example, crepes, into consumer cartons is, at the present time, done by hand. In the case of crepes, the extremely thin and fragile nature of the crepe material, often containing a very sticky filling, makes it difficult to devise a suitable automatic system which operates without damaging the crepes. In addition, it is essential that crepes are compactly placed in the package so that no movement occurs between the individual crepes which might cause damage and this is very difficult to ensure when using automatic methods.

Hand packing is labour intensive and it is desirable not only to reduce labour costs but also to ensure that the products are untouched by hand. Automatic packing methods have been described in the prior art but they have usually involved complicated arrangements making use of, for example, elevators or suction cups. We have now devised an extremely simple system using two conveyor belts which enables the food products to be packed into containers in a compact row without any damage occurring and substantially without any movement of the food products relative to one another in the final package.

SUMMARY OF THE INVENTION

The process of the present invention is effected by transporting open-topped containers discontinuously on a container-carrying conveyor which, at least at a position for filling the containers with articles of the food products, is inclined downwards at an acute angle of less than 60° to the horizontal in the direction of its travel. The food product articles are carried to the containers for packaging by transporting the food products on a food-product-carrying conveyor terminating in a leading, or forward, edge at the position of the container-carrying conveyor which is inclined, for enabling articles of the food products to fall in an abutting arrangement into the containers on the container-carrying conveyor beneath the leading edge. The machine of the present invention for carrying out this process thus includes a conveyor for transporting the food products to be packaged and a conveyor for transporting containers for receiving articles of food products which fall from the leading edge of the food-product-carrying conveyor. Beneath the leading edge of the food-product-carrying conveyor, the container-carrying conveyor is inclined downwards in its direction of travel at an acute angle of less than 60°. Advantageously, a continuously advancing container-supporting conveyor means may be utilized as a portion of the container-carrying conveyor for advancing and urging the containers into position for receiving the articles of the food products as disclosed below.

DETAILED DESCRIPTION OF THE INVENTION

Accordingly, the present invention provides a packing machine for packaging food products comprising a conveyor for carrying and transporting the food products to be packaged, and a conveyor for carrying and transporting open-topped containers adapted to travel towards and to pass beneath the forward edge of the food-product carrying conveyor characterized in that, at least at this position, the container-carrying conveyor is inclined downwards in the direction of travel at an acute angle of less than 60° to the horizontal and adapted to travel discontinuously so that when a container is positioned at successive stopping positions beneath the forward edge of the food-product carrying conveyor the food products may fall off the said forward edge consecutively into the container until the container is filled with the food products in a compact row.

The food product conveyor is conveniently an endless belt. The food product is preferably transported substantially horizontally. The container-carrying conveyor need only be transported at an acute angle to the horizontal at the position where it passes beneath the food-product carrying conveyor. Transport of the containers at an acute angle to the horizontal at this position enables the containers to be filled in a single row automatically leaving sufficient room for the final food product without having to compress it into position. The minimum angle necessary to enable this to happen can easily be determined and is usually not less than 5°. Preferably, the angle of the container-carrying conveyor is from 10° to 45° and especially from 15° to 30° to the horizontal.

At the position of the forward edge of the product-carrying conveyor, the distance between the product-carrying conveyor and the container-carrying conveyor is preferably as short as possible, particularly for soft food products, so that substantially no damage occurs to the products as they fall into the containers. This distance is such that the upper edge of the container may be, for instance, from 2 to 20 mm, preferably from 3 to 15 mm and especially from 4 to 10 mm below the forward edge of the product-carrying conveyor depending on the type of product and the speed of the product-carrying conveyor. Shorter distances are generally preferred for softer, more fragile products and for higher conveyor speeds.

Conveniently, the container-carrying conveyor is adapted to stop intermittently so that an empty container passing beneath the food-product carrying conveyor stops initially at a position where it front wall is substantially below the forward edge of the food-product carrying conveyor to enable a food product to fall into the container and abut against its front wall. Thereafter, the container intermittently travels a distance corresponding to the width of one food product and stops to allow further food products to fall into the container, each further food product abutting against the immediately preceding one until the container is full.

Advantageously, the container-carrying conveyor is a chain conveyor comprising a chain fitted with transverse container carrier bars, the distance between which is longer than the length of a container, and a fixed base for supporting the containers as they advance and which terminates at a position just in front of the forward edge of the food-product carrying container, after which a container-supporting conveyor means adapted to advance continuously is positioned between the chains and passes beneath the forward edge of the food product-carrying conveyor.

The fixed base for supporting the containers is conveniently mounted between the sides of the frame of the chain conveyor and is suitably a plastics sheet.

The containers are pushed by the transverse carrier bars so that they advance by sliding along the fixed base. At the termination of the fixed base, the containers are transferred onto the container-supporting conveyor means adapted to advance continuously so that it urges the containers to abut against the rear surface of the preceding transverse carrier bar as they pass beneath the forward edge of the food product-carrying conveyor. This ensures very accurate positioning of the container, as it stops intermittently beneath the forward edge of the food productcarrying conveyor, so that it abuts against the rear surface of the preceding transverse carrier bar. The container-supporting conveyor means adapted to advance continuously preferably comprises endless ropes, or bands, and advantageously at least one endless rope, or band, is positioned beneath each longitudinal edge of a container.

The endless conveyor ropes, or bands, may conveniently be made of plastics or rubber.

The process for packing food products into containers comprises transporting open-topped containers on a conveyor travelling towards and passing beneath the forward edge of a conveyor carrying the food products characterised in that, at least at the position beneath the forward edge of the conveyor carrying the food products the conveyor transporting the open-topped containers is inclined downwards in the direction of travel at an acute angle of less than 60° to the horizontal and travels discontinuously so that when a container is positioned at successive stopping positions beneath the forward edge of the food-product carrying conveyor the food products fall off the forward edge consecutively into the container until the container is filled with the food products in a compact row.

After being filled with the food products, the containers may then be transferred to another belt where they are conveyed away, for instance to a freezer.

While the machine and process of the present invention is suitable for packing a variety of food products, it is particularly suitable for packing soft food products such as pancakes and crepes in flat rows into containers such as cartons.

The present invention is further illustrated by way of example with reference to the accompanying drawings.

DESCRIPTION OF THE PREFERRED EMBODIMENT

Figures 1, 2:
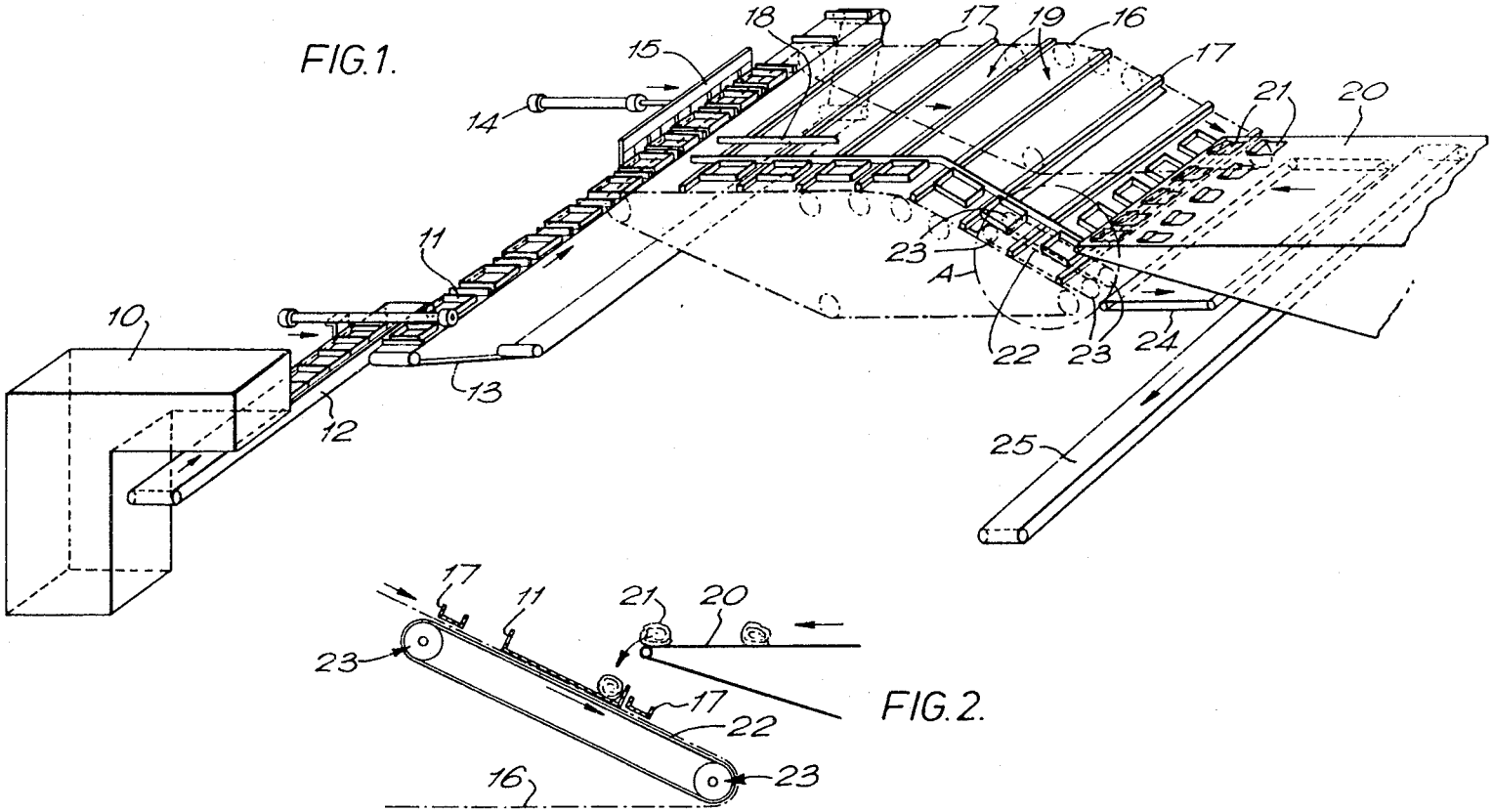
FIG. 1 is a diagrammatic side elevation of a machine of the present invention and FIG. 2 is an enlarged view of the area A in FIG. 1.

The apparatus comprises a Sprinter package forming machine 10 producing containers 11, an accumulation conveyor belt 12, a conveyor belt 13, a piston 14, a pusher assembly 15, and an endless container-carrying chain conveyor 16 adapted to travel discontinuously below and at right angles to the belt 13. The conveyor chain 16 is provided with container carrier bars 17 and adjustable guide rails 18, and a fixed plastics sheet base 19 is mounted between the sides of the frame. The endless conveyor chain 16 inclines downwards so that the upper edge of the container is 5 mm below the leading edge of a product-carrying conveyor belt 20 carrying rolled crepes 21. Just in front of the forward edge of the foodproduct carrying conveyor belt 20 the fixed plastics sheet 19 terminates and is followed by endless rubber ropes, or bands, 22 each having a diameter of 5 mm trained about rollers 23. The ropes, or bands, are arranged in pairs, one pair below each longitudinal edge of a container and they are adapted to advance continuously.

Beyond the forward edge of rubber ropes, or bands, 22 is a wire belt 24 adapted to advance continuously and a conveyor belt 25 for carrying away the filled containers.

In operation, containers 11 produced by the Sprinter package forming machine 10 are transported to the accumulation conveyor belt 12 and then to the conveyor belt 13. A piston 14 then activates a pusher 15 to push a row of five containers 11 laterally off the belt 13 onto the chain conveyor 16 driven discontinuouly by a step motor (not shown) where they slide on the fixed plastics sheet 19 to travel below and at right angles to belt 13. The row of containers is guided laterally by guide rails 18 and is pushed in the direction of the arrow by the carrier bars 17.

The conveyor chain 16 then inclines downwards and the containers 11 are then transferred from the plastics sheet onto the rubber ropes, or bands, 22 which travel at such a speed in the direction of the arrow causing the containers to be urged to abut against the rear surface of the preceding carrier bar 17. When the front edges of a row of containers 11 are directly below the forward edge of the food-product carrying conveyor belt 20 an electrical sensor is activated whereupon the chain 16 stops to enable a row of five crepes to fall, one into each container where each abuts against the front walls of the respective containers. Then the chain 16 advances for a distance corresponding to the diameter of one rolled crepe and stops again to allow a second row of five crepes to fall, one into each container where each abuts against the crepes already in the respective container. This intermittent motion continues until each container is filled with five crepes and then the chain 16 moves a longer distance to move the next container into position. The filled containers 11 are then transferred onto the continuously advancing wire belt 24 and then fall onto conveyor belt 25 which transports them to a freezer.

To avoid changing chains 16 when using containers of different sizes, the distance between the carrier bars 17 is determined by the longest containers in use and is preferably slightly longer. This longer distance makes it easier to transfer the containers 11 from the conveyor belt 13 to the conveyor chain 16.

By means of the adjustable guide rails 18, the machine can easily be adapted in width to varying numbers of containers in a row although it should be understood that pusher assembly 15 and conveyor belt 13 would need to be changed as well.

The open area between the pairs of rubber ropes, or bands, represents a free area through which the crepes can fall if, for some reason, no container is in position thus keeping the machine and containers clean.

All the movements of the machine may be controlled and synchronised automatically by conventional methods.

I claim:

1. A machine for packing food products in open-topped containers comprising:

a food-product-carrying conveyor for transporting food products for packaging terminating in a leading edge from which the transported products fall off the conveyor for packaging; and a container-carrying conveyor adapted to travel discontinuously for transporting open-topped containers to a position beneath the leading edge of the food-product-carrying conveyor for receiving articles of the food products falling off the leading edge of the food-product-carrying conveyor in an abutting row in the containers, the container-carrying conveyor being inclined downwards in its direction of travel, at least at the position beneath the leading edge of the food-product-carrying conveyor, at an acute angle of from 10° to less than 60° to the horizontal and having a containersupporting conveyor means beginning at a position at least prior to the position beneath the leading edge which is adapted for advancing continuously for urging containers into position for receiving the food product articles falling from the leading edge of the food-product-carrying conveyor in the abutting row.

2. A machine according to claim 1 wherein the container-carrying conveyor is inclined downwards at an angle of from 10° to 45° to the horizontal.

3. A machine according to claim 1 wherein the leading edge of the food-product-carrying conveyor is at a distance of from 2 mm to 20 mm above upper edges of the open-topped containers beneath the leading edge of the food-product-carrying conveyor.

4. A machine according to claim 2 wherein the leading edge of the food-product-carrying conveyor is at a distance of from 3 mm to 15 mm above upper edges of the open-topped containers beneath the leading edge of the food-product-carrying conveyor.

5. A machine according to claim 1 wherein the container-carrying conveyor is a chain conveyor comprising a chain filled with transverse container carrier bars spaced at a distance such that there is a space between a first leading carrier bar, a second pushing carrier bar and the containers and comprising a fixed base for supporting the containers as the containers are transported by the chain conveyor, the fixed base terminating at the container-supporting conveyor means.

6. A machine according to claim 5 wherein at least the container-supporting conveyor means is inclined at the acute angle at least at the position beneath the leading edge of the food-product-carrying conveyor.

7. A machine according to claim 5 wherein the container-supporting conveyor means urges containers to abut the first leading carrier bar for positioning the container beneath the leading edge of the food-product-carrier conveyor for packaging the food product articles.

8. A machine according to claim 5 wherein the container supporting conveyor means is comprised of endless bands.

9. A machine according to claim 8 wherein at least one band is positioned beneath each longitudinal edge of each container for open areas between the bands.

10. A machine according to claim 1 wherein the container-carrying conveyor is adapted to discontinuously travel such that it stops transporting containers for enabling a food product article falling from the leading edge of the food-product-carrying conveyor to fall into a container.

11. A machine according to claim 1 wherein the container-carrying conveyor is adapted to discontinuously travel such that it first stops transporting containers for enabling a front wall of a container to be substantially beneath the leading edge of the food-product-carrying conveyor for enabling a first food product article falling into the container to fall into and abut the front wall within the container, then successively starts and transports the containers for a distance corresponding to a width of one food product article and successively stops for enabling the container to be filled with the food product articles abutting each other.

12. A process for packing food products in open-topped containers comprising:

transporting open-topped containers discontinuously on a container-carrying conveyor which, at least at a position for filling the containers with articles of the food products, is inclined downwards at an acute angle of from 10° to less than 60° to the horizontal in its direction of travel and at the position for filling the containers, advancing and urging the containers into position for receiving food product articles with a continuously advancing container-supporting conveyor means; and transporting food product articles on a food-product-carrying conveyor terminating in a leading edge positioned, with respect to the container-carrying conveyor, at the inclined position of the container-carrying conveyor for receiving food products for enabling the food product articles to fall into the containers on the container-carrying conveyor beneath the leading edge for filling the containers in an abutting row.

13. A process according to claim 12 wherein the containers are first pushed towards the food-product-carrying conveyor by conveyor carrier bars abutting only a rear edge of the containers and then at least beneath the leading edge of the food-product-carrying conveyor, the containers are advanced and for urging and abutting only a forward edge of the containers against the container carrier bars.

14. A process according to claim 13 wherein the containers are transported at the inclined angle at least while being advanced for urging the forward edge to abut the carrier bars.

15. A process according to claim 12 wherein the container-carrying conveyor transports the containers discontinuously by stopping for enabling food product articles to fall into the containers.

16. A process according to claim 15 wherein the container-carrying conveyor transports the containers discontinuously by successive starting and stopping for enabling food product articles to fall into the containers while stopped and then starting for transporting the containers a distance corresponding to a width of one food product article and stopping for enabling consecutive filling of abutting food product articles into the containers from a forward edge of the containers to a rear edge of the containers.

17. A process according to claim 12 wherein the angle is from 10° to 45°.

* * * * *